US005966825A

United States Patent [19]

Biemont

[11] Patent Number: 5,966,825

[45] Date of Patent: Oct. 19, 1999

[54] ADJUSTABLE FRONT SIGHT FOR SMALL ARMS

[76] Inventor: Paul Biemont, 5 Rte. de Creully, 14610 Buron Cairon, France

[21] Appl. No.: 08/944,346

[22] Filed: Oct. 6, 1997

[51] Int. Cl.[6] ..... F41G 1/33

[52] U.S. Cl. ..... 33/252

[58] Field of Search ..... 33/254, 252

[56] References Cited

U.S. PATENT DOCUMENTS

| | | | |
|---|---|---|---|
| 1,438,694 | 12/1922 | Burton | 33/254 |
| 2,176,743 | 5/1939 | Loomis | 33/254 |
| 2,682,702 | 7/1954 | Dahlberg | 33/254 |
| 4,574,335 | 3/1986 | Frimer | 33/254 |
| 4,766,800 | 8/1988 | Miller et al. | 33/254 |

*Primary Examiner*—Charles T. Jordan
*Assistant Examiner*—Denise J. Buckley
*Attorney, Agent, or Firm*—Michael Best & Friedrich LLP

[57] ABSTRACT

The front sight comprises an A-shaped support whose top is formed by a cross-member between two raised side plates for protecting the front sight which is adjustably mounted in the cross-member. A knob is housed to rotate freely in the cross-member and is provided with an axial tapped hole. The front sight is constituted by an end in the form of a rod for aiming purposes and by a threaded body received in the tapped hole of the knob, said body being provided with a pin for preventing it from rotating, the pin being slidably received in two slots of the hole in the support that freely receives the body of the front sight. The knob projects sideways a little from the support to be accessible to the fingers, and it includes indexing means.

15 Claims, 2 Drawing Sheets

ADJUSTABLE FRONT SIGHT FOR SMALL ARMS

The present invention relates to an adjustable front sight for a small arm, in particular a machine pistol, a rifle, preferably an assault rifle, an more particularly an assault rifle of the M16 A1-A2-A3 series or an assault rifle having the same technical characteristics and sold under some other name. The front sight of the invention comprises: an A-shaped support whose two main limbs comprise a short limb and a long limb and are terminated at their bottom ends by respective collars for fixing on the gun barrels; the short main limb followed by a sloping limb to join the long main limb at the top of the support; and the top of the support being formed by a cross-member between two raised side plates for protecting the front sight which is adjustably mounted in the cross-member.

BACKGROUND OF THE INVENTION

Such an adjustable front sight for a gun in the M16 series is already known. The front sight is constituted by a part provided with an end constituting the sight proper and with a threaded body screwed into a tapped hole in the top cross-member of the front sight support, between the two side plates. The front sight also includes an intermediate part in the form of a washer with peripheral notches, e.g. four notches. A locking stud is provided on the circle of the peripheral notches, sliding in a hole and bearing against the bottom thereof by means of a spring. The locking slide is formed of a cylindrical body terminated by an end that is also cylindrical, but of smaller diameter so as to form a shoulder.

This smaller end occupies a corresponding notch of the front sight disk, while bearing against the bottom face of the disk via its shoulder.

To adjust the front sight, i.e. to lower it by screwing it in or to raise it, it is possible to use a hook or a point to press down the member that prevents rotation so as to retract it, thereby allowing the front sight to be turned using a special tool in the form of a tube provided with teeth that engage in the notches of the front sight disk. The tooth overlying the locking member pushes away said and allows the front sight to be turned since the other teeth are occupying the other notohes in the front sight disc, thereby preventing the looking member from moving beak out.

Nevertheless, this operation is relatively fiddly since the locking member will move back out whenever the next notch come over the housing for the locking member.

That front sight therefore suffers from the drawback of requiring special tool which is relatively small and easily lost, or which is not easy to handle in order to perform adjustment.

OBJECTS AND SUMMARY OF THE INVENTION

An object of the present invention is to provide a front sight that is suitable for this particular type of gun, and that an be adjusted easily without requiring any special tool, while nevertheless avoiding the risk of falling easily out of adjustment.

To this end, the invention provides a front sight of the above-defined type, comprising a knob mounted free to rotate in the cross-over and provided with an axially tapped hole; the front sight is constituted by an end in the form of a rod for aiming purposes, and by a threaded body received in the tapped hole of the knob, said body being provided with a pin for preventing it from rotating, and itself slidably received in two slots of the hole in the support that freely receives the body of the front sight; and the knob projects slightly from the side of the support so as to be accessible to the fingers, and it includes indexing means.

The front sight of the invention is easily made by casting. Putting the parts into place, i.e. the indexing means for the knob and the front sight proper, are operations which are very simple. Finally, adjustment in pertioularly easy since it suffices to turn the knob, e.g. by holding it between the index finger and the thumb, in order to turn it. The knob may have a relatively large number of indexing positions, thereby increasing the precision of front sight adjustment and making micrometer adjustment possible.

Since only the edge of the knob is accessible from the outside, the indexing means or the portion of the indexing means on the knob is not exposed and does not run any risk of picking up dirt.

The indexing is fore always operational.

In particularly advantageous manner, the indexing means of the knob is constituted by spherical cavities distributed around a circle on the bottom face of the knob, and by a ball biassed by a spring housed in the support beneath the knob so that the ball is urged into the cavities of the knob to hold it against rotation.

This indexing means is simple to make and easy to operate. When the ball is received in a cavity of the bottom face of the knob, the knob can escape therefrom providing a certain level of torque is applied thereto, while still ensuring that the knob is held in place sufficiently securely to avoid any danger of losing adjustment. In addition, the hole whose portion beneath the knob receives the ball and the spring, also has a portion above the knob which constitutes a window through which it is possible to see a knob adjustment number. The numbers associated with each indexing position also make it possible to see the direction in which adjustment is taking place and, where appropriate, to remember it.

BRIEF DESCRIPTION OF THE DRAWINGS

The present invention is described below in greater detail with reference to the accompanying drawings, in which.

MORE DETAILED DESCRIPTION

Figure 1:
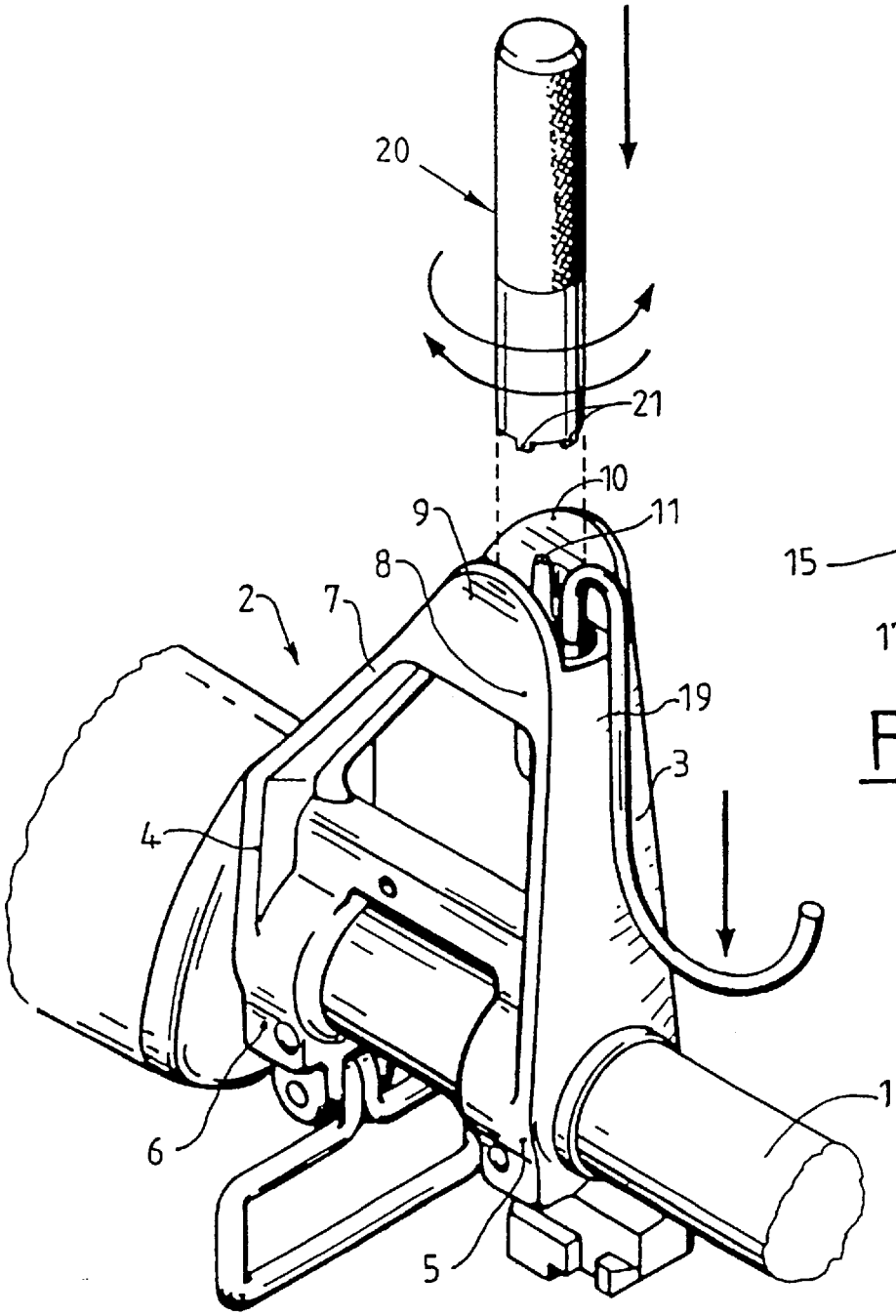
FIG. 1 in a perspective view of a prior art front sight and of two adjustment means.
Figure 1A:
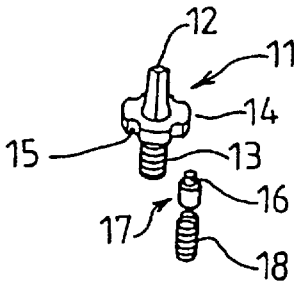
FIG. 1A is a perspective view of the front sight proper and of its locking member.

In FIGS. 1 and 1A, a known front sight is mounted on an assault rifle of the M16 A1-A2-A3 series, represented solely by its barrel 1. The front sight is given overall reference 2 and comprises a support that is generally A-shaped with two main limbs 3 and 4 terminating at their bottom ends in collars 5 and 6 for fixing the front sight 2 on the gun barrel.

The limbs 3 and 4 are not equal in length. The limb 3 at the front of the rifle extends upwards to the support, while the short main limb 4 is followed by a sloping limb 7 which runs into the top portion of the support. This top portion is formed by a cross-member 8 between two side plates 9 and 10. The raised side plates protect the front sight proper 11 which is screwed into the cross-member. The front sight 11 is shown separately in FIG. 1A, It compromises an end 12 used far aiming purposes, and a threaded body 13 for screwing into the cross-member. These two portions are on opposite sides of a collar 14 provided with four notches 15. These notches serve to receive the end 16 of a locking member 17 which is slidably mounted in a hole (not shown) situated on the circle of notches 15 belonging to the collar 14. This member 17 is biassed by thrust from A spring 18.

In order to enable the front sight 11 to be screwed up or down, it is necessary to push the member 16 below the collar 14, and this can be done by means of a hook-shaped tool 19 with a screw-driving sleeve tube 20 having teeth 21. The sleeve tube 20 enables the front sight to be turned continuously without having to stop each time a notch 15 comes over the looking member 16.

The drawbacks of an adjustable front sight of that type are mentioned above.

The front sight of the invention is shown in FIGS. 2 to 5.

These figures show only the top portion of the support, its other portions being identical to those already describe and shown in FIG. 1.

Parts that am identical to those described above are given the same reference plus 20.

The front sight support 22 comprises cross-member 28 provided with a through housing 40 that opens out in both faces of the support. This housing is below the top surface 41 of the cross-member 28.

A hole 42 passes through the housing 40 and continues inside the long main limb 23 of the support. This hole 42 is offset form the center of the housing.

Figure 3A:
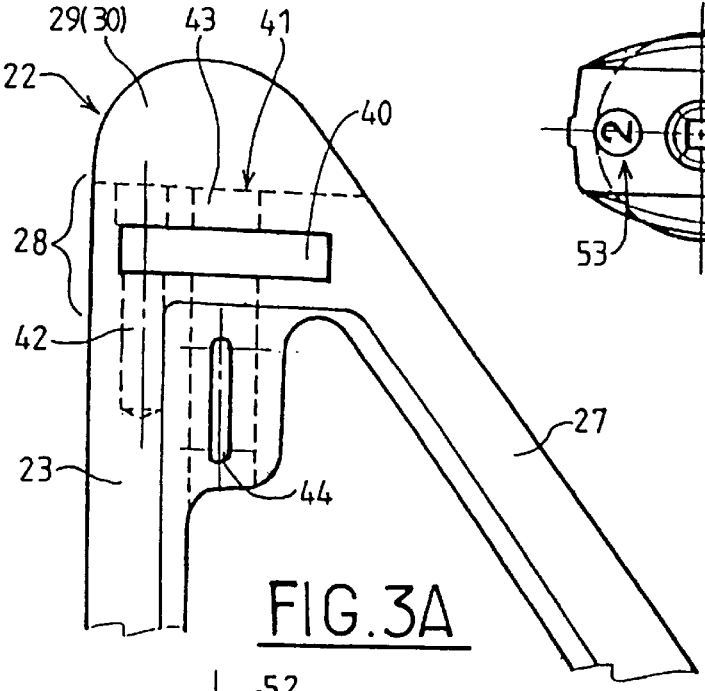
FIG. 3 is a fragmentary side view of the front sight of the invention.
FIG. 3B is a plan view corresponding to FIG. 3A.
Figure 3B:
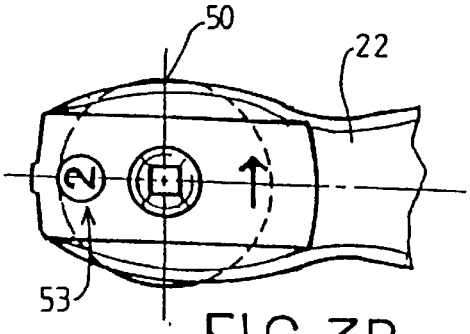
Figure 4:
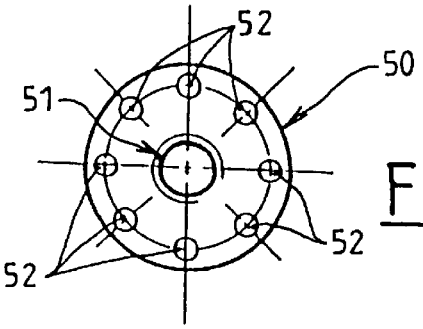
FIG. 4 to a view of the underside of the knobs.

However, in the center of the housing, the cross-member 28 includes a hole 43 that opens out into the surface 41 and that goes down into the cross-member and on beneath it, as for as the limb 23. Beneath the housing 40, the hole 43 opens out to both sides via two lateral slots 44. The other and of the hole 43 may even be open, as shown in FIGS. 2 and 3A.

Figure 5:
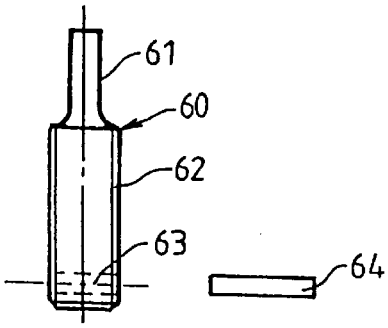
FIG. 5 is a side view of the front sight proper.

The housing 40 is designed to receive a knurled knob 50 (FIG. 4) and the hole 43 receives the front sight 60 (FIG. 5).

Figure 2:
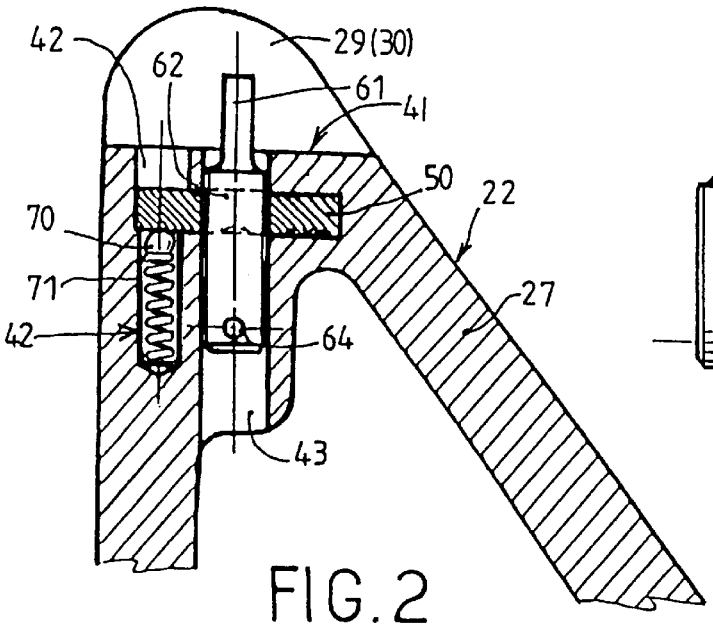
FIG. 2 is a vertical section through a front sight of the invention.

Finally, the hole 42 receives indexing means constituted by a ball 70 urged by a spring 71 against the bottom face of the knob 50 (FIG. 2).

The holes 42 and 43 have smooth bores.

The knob 50 has a radius which is just large enough to allow it to project slightly from the outline of the cross-member 28 of the front sight (FIG. 3) so as to make it accessible to the fingers, and it is in the form of a disk of adequate thickness and provided with a tapped central hole 51. Th bottom face of the knob also includes indexing cavities 52 that are distributed around a circle coaxial about the tapped hole 51. The cylindrical outside face of the knob is knurled to provide anti-slip grooving.

The front sight 60 has a top and 61 used for aiming purposes and a threaded body 62. The characteristics of the body 62 and of its thread correspond to those of the topped hole 51 in the knob, so as to enable the body 62 to be screwed into the tapped hole 51.

The body 62 is also provided with a through hole 63 for receiving a locking pin 64 (FIG. 2) that is received in the oblong slots 44 (FIG. 3A).

The above-described front sight is assembled as follows:

Starting with the shape of support shown in FIG. 3A, having the housing 40, the holes 42 and 43, and the lateral slots 44, the spring 71 in placed in its housing 42 and then the ball 70 is placed on top and pushed down with a pusher pin to allow the knob 50 to be slid into its housing 40, after which the front sight 60 is inserted from above, with its body 62 being screwed into the tapped hole 51 of the knob. The front sight 60 is caused to penetrate into the hole 43 until the hole 63 can be seen in the slots 44. It is then possible to engage the pin 64 in the hole 63. This pin prevents the front sight 60 from rotating, thereby constraining it to move in translation in the hole 43.

The translation moment is controlled by rotating the knob 50 in screw engagement on the body 62 of the front sight 60.

The knob 50 is retained in the selected indexing position by the indexing means constituted by the ball 70 urged by the spring 71. The ball 70 received in one of the cavities 52 in the bottom face of the knob 50, depending on the selected rotational position for the knob.

The top face of the knob 50 may have identification marks 53 such digits (the digit "2", FIG. 3B) which can be seen through the cavity 52 above the housing 40 of the knob 50.

The front sight m in this way is easily adjusted merely by rotating the knob 50 in one direction or the other to cause the front sight 60 to up or down, i.e. to move its aiming tip 61 relative to the surface 43.

I claim:

1. An adjustable front sight assembly for a small arm, the small arm having a gun barrel, the front sight assembly comprising:

an A-shaped support whose two main limbs comprise a short limb and a long limb and are terminated at their bottom ends by respective collars for fixing on the gun barrel, the support defining a hole, the short main limb being followed by a sloping limb to join the long main limb at the top of the support, and the top of the support being formed by a cross-member between two raised side plates for protecting a front sight which is adjustably mounted in the cross-member; and a knob mounted free to rotate in the cross-member and provided with an axially tapped hole;

wherein the front sight is constituted by an end in the form of a rod for aiming purposes, and by a threaded body received in the tapped hole of the knob, the body being provided with a pin for preventing the body from rotating, and the pin being slidably received in two slots of the hole in the support that freely receives the body of the front sight; and wherein the knob projects slightly from the side of the support so as to be accessible to the fingers, and includes indexing means.

2. A front sight according to claim 1, wherein the indexing means of the knob is constituted by spherical cavities distributed around a circle on a bottom face of the knob, and by a ball biassed by a spring housed in the support beneath the knob so that the ball is urged into the cavities of the knob to hold the knob against rotation.

3. An M16 series assault rifle comprising:

a gun barrel; and a front sight assembly including an A-shaped support whose two main limbs comprise a short limb and a long limb and are terminated at their bottom ends by respective collars for fixing on the gun barrel, the support defining a hole, the short main limb being followed by a sloping limb to join the long main limb at the top of the support, and the top of the support being formed by a cross-member between two raised side plates for protecting a front sight which is adjustably mounted in the cross-member, and a knob mounted free to rotate in the cross-member and provided with an axially tapped hole, wherein the front sight is constituted by an end in the form of a rod for aiming purposes, and by a threaded body received in the tapped hole of the knob, the body being provided with a pin for preventing the body from rotating, and the pin being slidably received in two slots of the hole in the support that freely receives the body of the front sight, and wherein the knob projects slightly from the side of the support so as to be accessible to an operator's fingers and includes indexing means.

4. A rifle according to claim 3, wherein the indexing means of the knob is constituted by spherical cavities distributed around a circle on a bottom face of the knob, and by a ball biassed by a spring housed in the support beneath the knob so that the ball is urged into the cavities of the knob to hold the knob against rotation.

5. A gun comprising:

a gun barrel; and a front sight assembly, the front sight assembly including an A-shaped support whose two main limbs comprise a short limb and a long limb and are terminated at their bottom ends by respective collars for fixing on the gun barrel, the support defining a hole, the short main limb being followed by a sloping limb to join the long main limb at the top of the support, and the top of the support being formed by a cross-member between two raised side plates, a knob mounted free to rotate in the cross-member and provided with an axially tapped hole, and a front sight adjustably mounted in the cross-member and between the two raised side plates, the front sight being constituted by an end in the form of a rod for aiming purposes, and by a threaded body received in the tapped hole of the knob, the body being provided with a pin for preventing the body from rotating, and the pin being slidably received in two slots of the hole in the support that freely receives the body of the front sight;

wherein the knob projects slightly from the side of the support so as to be accessible to an operator's fingers and includes indexing means.

6. A gun according to claim 5, wherein the indexing, means of the knob is constituted by spherical cavities distributed around a circle on a bottom face of the knob, and by a ball biassed by a spring housed in the support beneath the knob so that the ball is urged into the cavities of the knob to hold the knob against rotation.

7. A front sight assembly for a small arm, the small arm having a gun barrel, the front sight assembly comprising:

a support adapted to be fixed on the gun barrel;

a knob rotatably mounted in the support and provided with an axially tapped hole, the knob projecting from at least one side of the support so as to be accessible to an operator's fingers; and a front sight including an end for aiming purposes and a threaded body received in the tapped hole of the knob so that the front sight is adjustably mounted in the support, the body being prevented from rotating relative to the support.

8. A front sight assembly according to claim 7, wherein the knob includes indexing means to selectively hold the knob against rotation.

9. A front sight assembly according to claim 8, wherein the indexing means includes spherical cavities distributed around a circle on a bottom face of the knob, a ball, and a spring housed in the support beneath the knob and biasing the ball so that the ball is urged into the cavities of the knob to selectively hold the knob against rotation.

10. A front sight assembly according to claim 7, wherein the support includes an A-shaped support member whose two main limbs comprise a short limb and a long limb and are terminated at their bottom ends by respective collars for fixing on the gun barrel, the short main limb being followed by a sloping limb to join the long main limb at the top of the support, and the top of the support being formed by a cross-member between two raised side plates for protecting the front sight which is adjustably mounted in the cross-member.

11. A front sight assembly according to claim 7, wherein the support defines a hole and a slot communicating with the hole, wherein the front sight is received in the hole in the support, wherein the body of the front sight is provided with a pin for preventing the body from rotating, the pin being slidably received in the slot in the support.

12. A front sight assembly according to claim 7, wherein the knob projects from opposite sides of the support.

13. A front sight assembly according to claim 7, wherein the front sight is adjusted without additional tools.

14. A front sight assembly according to claim 7, wherein the knob further includes identification means on a top surface of the knob to indicate the rotational position of the knob.

15. A front sight assembly according to claim 14, wherein the support defines a second hole spaced from the first-mentioned hole, and wherein the identification means is visible through the second hole.

* * * * *